US005242217A

United States Patent [19]

Gonnet

[11] Patent Number: 5,242,217

[45] Date of Patent: Sep. 7, 1993

[54] DESK WITH COMPUTER WORK STATION

[76] Inventor: Henry M. Gonnet, 126 Pixley St., No. 2, San Francisco, Calif. 94123

[21] Appl. No.: 817,095

[22] Filed: Jan. 6, 1992

[51] Int. Cl.[5] ..... A47B 21/00; A47B 51/00

[52] U.S. Cl. ..... 312/194; 312/196; 312/312

[58] Field of Search ..... 312/194, 196, 312

[56] References Cited

U.S. PATENT DOCUMENTS

| | | | |
|---|---|---|---|
| 491,249 | 2/1893 | Reynolds | 312/196 |
| 2,019,455 | 10/1935 | Lehman | 312/312 |
| 2,533,155 | 12/1950 | von Hacht | 312/194 |
| 2,660,502 | 11/1953 | Smith | 312/194 |
| 4,345,803 | 8/1982 | Heck | 312/196 |
| 4,669,789 | 6/1987 | Pemberton | 312/194 |
| 4,755,009 | 7/1988 | Price et al. | 312/194 |
| 4,766,422 | 8/1988 | Wolters et al. | 312/194 |
| 4,828,342 | 5/1989 | Stefan | 312/312 |
| 5,071,204 | 12/1991 | Price et al. | 312/194 |
| 5,101,736 | 4/1992 | Bommarito et al. | 312/194 |

FOREIGN PATENT DOCUMENTS

| | | | |
|---|---|---|---|
| 0258255 | 11/1948 | Switzerland | 312/196 |
| 0591288 | 8/1947 | United Kingdom | 312/194 |
| 0886322 | 1/1962 | United Kingdom | 312/194 |

*Primary Examiner*—Victor N. Sakran
*Attorney, Agent, or Firm*—Douglas E. White

[57] ABSTRACT

A desk includes a desktop divisible by a longitudinal axis into right and left portions and a knee recess formed under one of said portions having at least one side opening outward along a first vertical plane, which first plane is perpendicular to the longitudinal axis. The desk has a monitor compartment formed under the other of said portions and an automatic lift assembly for lifting at least a computer monitor from a closed position fully beneath the desktop and within the monitor compartment to an open position fully above the desktop. A hinged lid in an aperture in the desktop communicates with the lift assembly. The lid lies flush with the desktop in a closed lid position and has a front lid edge which forms an acute lid edge angle with the transverse axis of the desktop. A keyboard shelf is used for extending a computer keyboard from a first keyboard position wholly beneath the desktop, to a second keyboard position wholly in front of the front edge of the desk and parallel to the transverse axis, and to a third keyboard position wholly in front of the front edge of the desk wherein the transverse axis of the keyboard forms an acute angle with the transverse axis of the desktop.

18 Claims, 8 Drawing Sheets

DESK WITH COMPUTER WORK STATION

FIELD OF THE INVENTION

This invention relates to desks, more particularly to a desk which contains an automatically elevating computer work station.

BACKGROUND OF THE INVENTION

Presently, computer equipment more or less permanently occupies space on a desktop, even though the computer may be used only part of the time. While it is known to move the central processor/drive (CPU) case and/or the keyboard off of the desktop and out of the way, the monitor alone takes up considerable space on the desktop, which space otherwise often could be put to other uses. Furthermore, some business professionals and other computer users would prefer to completely disguise their computer equipment on occasions when they meet with clients, co-workers or the like. Many will also prefer that the central area of the desk above the knee recess remain free and unobstructed by computer equipment.

Prior developments in this field may be generally illustrated by reference to the following patents:

| Patent No. | Patentee | Issue Date |
|---|---|---|
| 3,761,152 | J. Cory | Aug. 10, 1971 |
| 4,717,212 | K. Roberts | Jan. 05, 1988 |
| 3,938,766 | B. Herbolsheimer et al. | Feb. 17, 1976 |
| 4,828,342 | A. Stefan | May 09, 1989 |
| 4,695,104 | E. Lederman | Sep. 22, 1987 |
| 4,766,422 | R. Wolters et al. | Aug. 23, 1988 |
| 4,669,789 | P. Pemberton | Jun. 02, 1987 |
| 4,345,803 | P. Heck | Aug. 24, 1982 |
| 4,836,623 | R. Holland | Jun. 06, 1989 |

U.S. Pat. No. 3,761,152 teaches a motorized cabinet that elevates a TV monitor and which has a pulley and cable system of elevation. Limit switches are utilized therein.

U.S. Pat. No. 3,938,766 teaches a hand-crank powered lifting system of the jack-screw or acme type which is used for raising and lowering a typewriter.

U.S. Pat. No. 4,717,212 teaches a rack and pinion power lift system for a sewing machine that enables the machine to be hidden away when not being used.

U.S. Pat. No. 4,828,342 teaches a scissors-type lift designed for a computer monitor and CPU that is electrically operated and lockable.

U.S. Pat. No. 4,345,803 shows, in FIGS. 4 and 8, a work station desk where the monitor may rest off to one side. A monitor recess may be filled with block inserts to restore a level top surface, but not while the monitor is installed therein and not automatically.

U.S. Pat. Nos. 4,695,104, 4,766,422, and 4,669,789 teach desks with computer supports that can be folded in a manner that the computer is hidden from view when not being used.

U.S. Pat. No. 4,836,623 teaches an executive's desk that can convert from a standard desk to a computer center.

Some of the patents show hinged monitor covers which act as level work space when closed. U.S. Pat. No. 4,695,104 shows one which is of a bi-fold type.

None of the patents teach using a side compartment to contain an automatic monitor lift assembly.

SUMMARY OF THE INVENTION

The present invention is a desk whose top is clear and unobstructed along its entire width in a first or closed monitor position. In the closed position, a computer monitor is stored in a compartment beneath the work station area of the desktop. The computer keyboard is stored in a separate compartment, also located beneath the desktop. The printer and/or the CPU may be stored in yet additional compartments or may be located elsewhere with respect to the desk.

The monitor rests on a platform which may be made to move up and down, preferably directly by motor driven screws (commonly known as acme screws). However, it also could be elevated by the common expanding scissor-type assembly (such as is used on some car jacks) which assembly is itself lifted by motor driven screws, or it could be elevated by motor driven hydraulic-type gas cylinders. Finally, the gas cylinders or the acme screws could be hand driven — by crank or by other means. The CPU may also be positioned on the platform, beneath the monitor.

When the monitor platform is thus raised out of its compartment beneath the desktop, a lid push rod presses up against a two-part hinged lid which is an integral part of the flat, horizontal desktop. This push rod (rather than the top of the monitor) automatically raises the lid. When the monitor is fully extended upward, passing through a second, intermediate position, it occupies a third or open monitor position, which position is its traditional location above the plane of the desktop, where it may be readily and comfortably viewed. The lid may be lockable when the monitor is in the closed position, for security.

An electric switch controls the up and down movement of the monitor platform. Limit switches automatically shut the motor off when the platform and monitor reach either the fully open or the fully closed position.

The monitor compartment is located off to one side of the knee recess. The keyboard slides manually out of its compartment and thereafter travels a short arc sideways so that it directly faces the monitor. The knee recess and the monitor compartment may be viewed as being located under the desktop on opposed sides of an imaginary longitudinal (front-to-back) axis of the desk which separates the desktop into right and left portions. Therefore, the portion of the desktop immediately above the knee recess, which is the area most convenient to the user's hands, always remains free and undisturbed for the placement and uninterrupted storage of a deskpad, pen set, working papers, or the like. The portion on the other side of the longitudinal axis is also temporarily free for such items during the time that the monitor is down in its compartment.

Interior surfaces of the monitor compartment may be lined with lead o other types of commercially available protection panels, in order to help shield the user from potentially harmful electromagnetic radiation. The skewed placement of the work station area increases the distance from the monitor to the user, which further protects from such radiation, whose strength decreases with the square of the distance.

Retaining the monitor and other parts of the computer in closed compartments offers significant dust protection that reduces the time which must be spent on the difficult process of cleaning. It also extends the life of the computer by reducing the amount of dust resting on the electronic components, which build-up of dust prevents proper cooling.

FEATURES AND ADVANTAGES

A principal feature of this invention is the provision of an automatic lift assembly for computer apparatus which is set off to one side of the knee recess of a desk, which configuration both extends the useful area of the knee recess the full length of the desk longitudinally (front to back) and frees all of the area of the desktop immediately above the knee recess for continuous storage and work.

Accordingly, an object of this invention is to disclose a desk apparatus which includes a desktop divisible by a longitudinal axis into right and left portions and a knee recess formed under one of said portions having at least one side opening outward along a first vertical plane, which first plane is perpendicular to the longitudinal axis. Further included is a monitor compartment formed under the other of said portions; automatic means for lifting at least a computer monitor from a first monitor position fully beneath the desktop continuously through an intermediate second monitor position to a third monitor position fully above the desktop; and side and back wall means (and/or legs) for elevating the desktop a distance above the floor comfortable for working thereupon.

Another feature or object is a straight front desktop edge formed along a transverse axis of the desktop perpendicular to the longitudinal axis, the transverse axis lying parallel to or within the first plane. The desk apparatus further includes moveable shelf means for extending a computer keyboard from a first keyboard position wholly beneath the desktop and back of the front edge, to a second keyboard position wholly in front of the front edge and parallel to the transverse axis, and to a third keyboard position wholly in front of the front edge and forming an acute keyboard angle with the transverse axis.

Another advantage of this desk is a computer peripheral storage compartment or compartments under the same desktop portion as the knee recess.

Yet another feature is a hinged lid in an aperture in the desktop communicating with the lifting means, the lid lying flush with the desktop in a closed lid position.

Still another feature is that the lifting means includes a plurality of acme screws driven by an electric motor. Alternatively, the lifting means may include a plurality of hydraulic cylinders powered by an electric pump.

A feature is that the lid is formed of two flat panels, a front panel and a back panel, hinged together. The desk includes a raisable platform in the lifting means for holding at least a computer monitor for lifting, the platform having a vertically upwardly protruding push rod which contacts the lid and opens the lid upward when the platform is raised.

An object or feature of the lid is that the front lid panel is rectangular and has a front lid edge which forms an acute lid edge angle with the transverse axis, the lid edge angle being substantially equal to the acute keyboard angle.

The desk may include as a useful feature a door of the monitor compartment lying within a second vertical plane, the second plane forming an acute door angle with the transverse axis.

As a safety feature, the desk may include radiation protection panels lining at least part of the monitor compartment.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, such words as "upwardly," "downwardly," "leftwardly," and "rightwardly" will refer to directions in the drawings to which reference is made unless otherwise stated. Similarly, such words as "inwardly" and "outwardly" will refer to directions toward and away from, respectively, the geometric center of a device and designated parts thereof.

DRAWING REFERENCE NUMERALS

Figure 1:
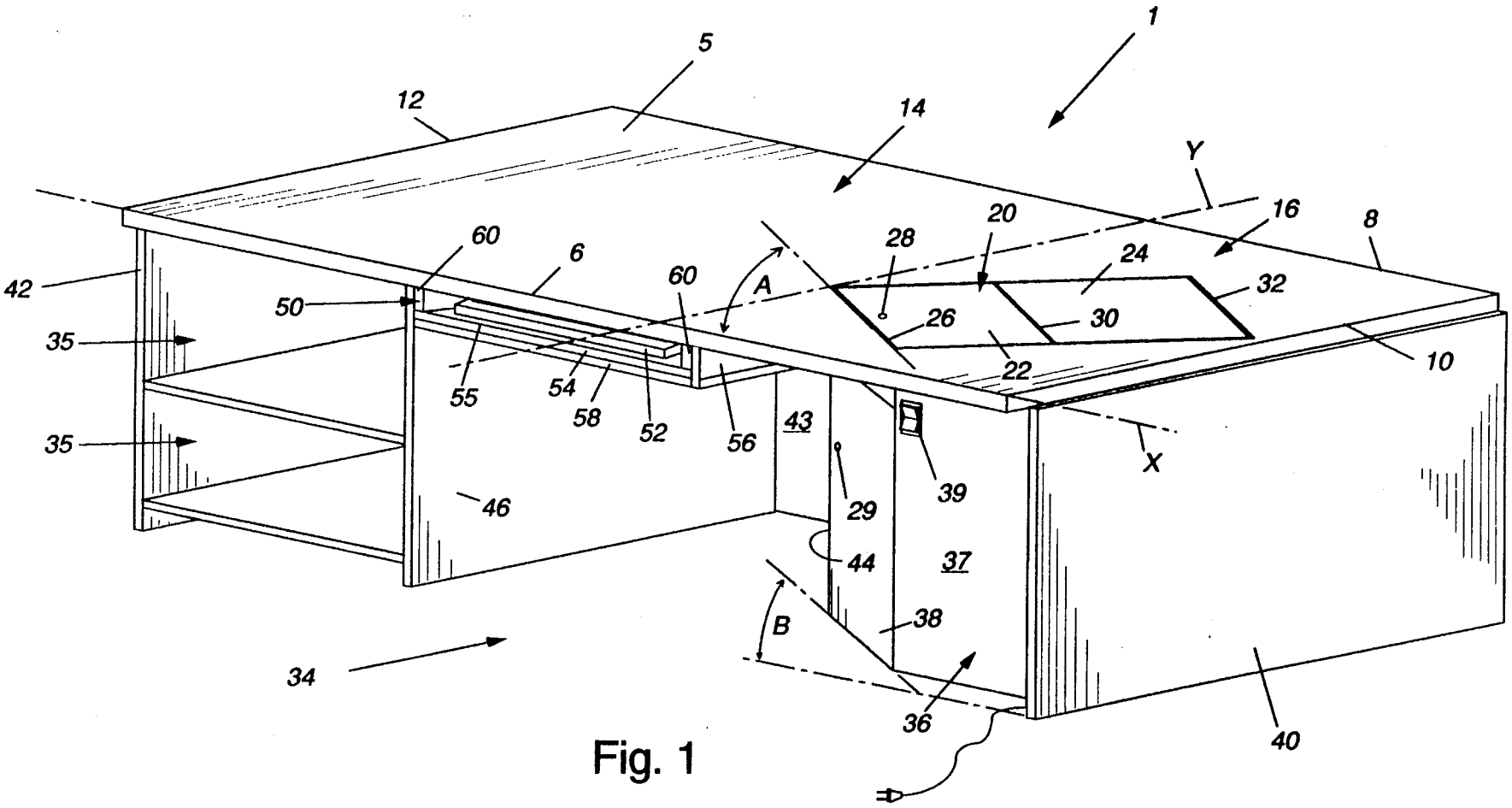
FIG. 1 is a perspective view of a desk of this invention in a first position.

| | |
|---|---|
| 1 | desk |
| 2 | monitor |
| 3 | screen of 2 |
| 4 | CPU |
| 5 | desktop |
| 6 | front edge of 5 |
| 8 | back edge of 5 |
| 10 | right edge of 5 |
| 12 | left edge of 5 |
| 14 | free area of 5 |
| 16 | work station area of 5 |
| 20 | lid of 16 |
| 22 | front panel of 20 |
| 24 | back panel of 20 |
| 26 | front edge of 22 |
| 28 | lock in 22 |
| 29 | lock in 38 |
| 30 | hinge between 22, 24 |
| 32 | hinge between 24, 5 |
| 34 | knee recess |
| 35 | peripheral compartment |
| 36 | monitor compartment |
| 37 | front wall of 36 |

-continued

| | |
|---|---|
| 38 | door of 36 |
| 39 | switch for 83 |
| 40 | right side wall |
| 42 | left side wall |
| 43 | back wall |
| 44 | right knee wall |
| 46 | left knee wall |
| 50 | keyboard compartment |
| 52 | keyboard |
| 54 | keyboard shelf |
| 55 | front edge of 54 |
| 56 | shelf wall |
| 58 | shelf floor |
| 60 | guide block for 54 |
| 62 | roller |
| 63 | roller |
| 64 | roller |
| 65 | roller |
| 66 | roller |
| 67 | stopper |
| 68 | stopper |
| 69 | stopper |
| 70 | bracket for 62 |
| 71 | bracket for 63 |
| 72 | notch in 54 |
| 74 | radiation protection panel |
| 75 | hinge for 38 |
| 80 | lift assembly |
| 82 | frame of 80 |
| 83 | motor of 80 |
| 84 | drive belt |
| 85 | pulley |
| 86 | acme screw |
| 87 | follower belt |
| 88 | pulley |
| 89 | acme screw |
| 90 | monitor platform |
| 91 | bar for 90 |
| 92 | nut in 91 |
| 93 | ball bearing in 82 |
| 94 | aperture in 90 |
| 95 | limit switch |
| 96 | push rod on 90 |
| A | angle |
| B | angle |
| C | angle |
| X | axis |
| Y | axis |
| 120 | lid |
| 122 | front panel of 120 |
| 124 | back panel of 120 |
| 130 | hinge |
| 132 | hinge |
| 180 | lift assembly |
| 182 | frame of 180 |
| 183 | pump |
| 189 | hydraulic gas cylinder |
| 190 | monitor platform |
| 191 | bar for 190, 189 |
| 194 | aperture in 190 |
| 196 | push rod on 190 |
| 197 | hydraulic line |
| 198 | base nut |

DESCRIPTION OF A PREFERRED EMBODIMENT

Figure 2:
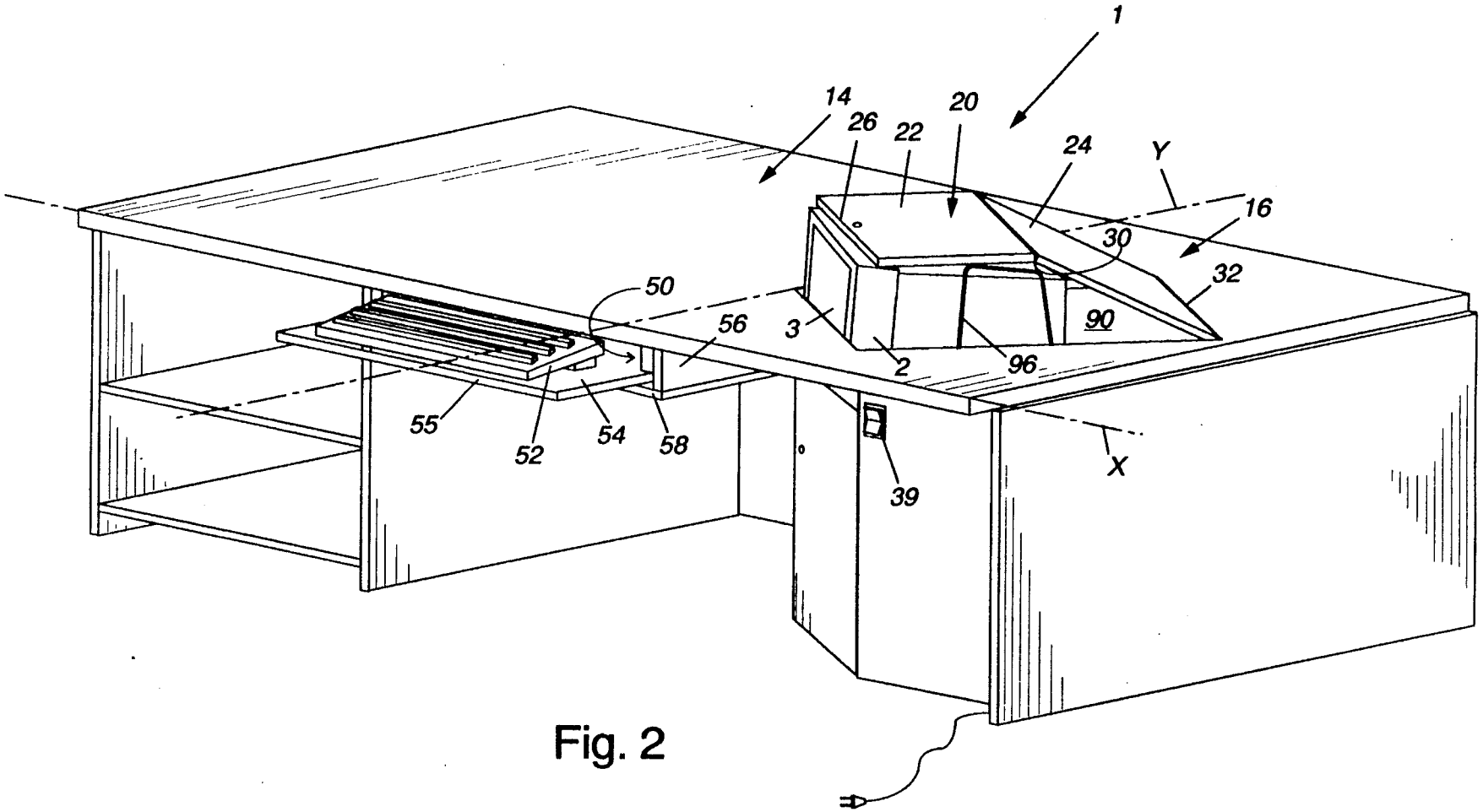
FIG. 2 is a perspective view of the desk of FIG. 1 showing the keyboard and the monitor in second positions.
Figure 3:
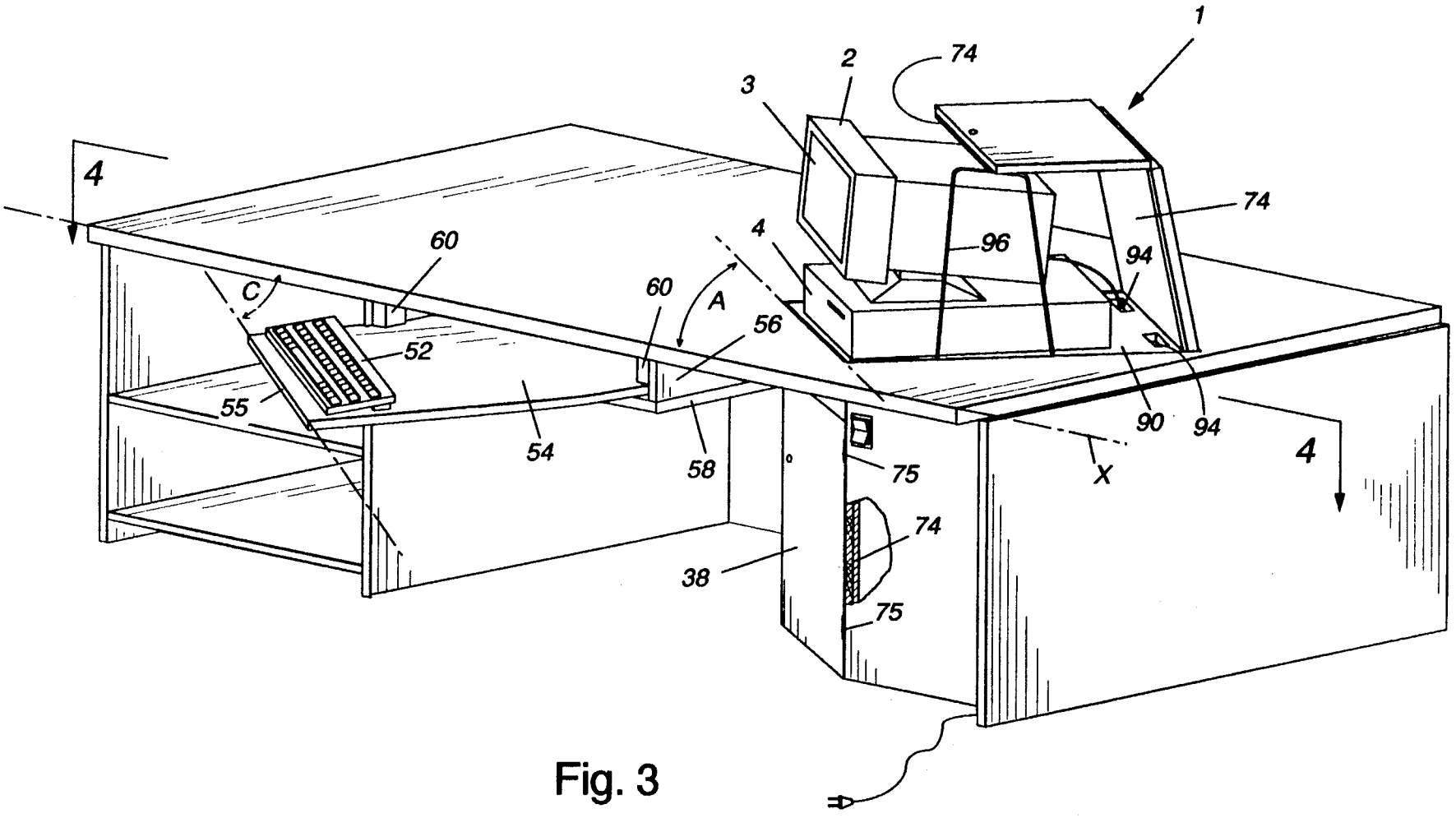
FIG. 3 is a perspective view of the desk of FIG. 1 showing the keyboard and the monitor in third positions.

Referring to FIGS. 1–3, there is illustrated therein a desk 1 of this invention in a series of successive positions. In the first position shown in FIG. 1, the desk has a flat horizontal desktop 5, which desktop is available for work and the placement of work papers or other items about its entire upper surface. Furthermore, the desktop, in the position of FIG. 1, presents a pleasing uncluttered and unobstructed view to the user and other observers.

Referring briefly to FIG. 3, it can be seen that the desk 1 automatically is able to elevate a computer monitor 2, having a viewing screen 3, to a viewing position. If desired, the CPU 4 of the computer can be used to support the monitor 2, as is common in fixed-position work stations.

Returning to FIG. 1, the desktop 5 is preferably a rectangle bounded by front 6, back 8, right 10 and left 12 edges. However, the top could be formed into an oval or other pleasing shape.

It is helpful to imagine a horizontal longitudinal (front-to-back) Y-axis, which Y-axis divides the desktop 5 into two opposed portions, namely, a free area 14 on the left of the Y-axis and a work station area 16 on the right thereof. Of course, the positions of these two areas with respect to the Y-axis could easily be reversed.

A lid 20 forms part of the work station area 16 of the desktop 5. The lid 20 rests flush with the desktop in an aperture, when in the position of FIG. 1, so as to present an unbroken horizontal work surface. The lid comprises a front panel 22 and a back panel 24. The panels preferably are disposed on the desktop so that the front edge 26 of the front panel (or, the front edge of its aperture) forms a line which makes an acute lid edge angle A with the transverse (side-to-side) X-axis, which axis is taken, for convenience, along the front edge 6 of the desktop 5. A lock 28 may be integrated into the lid 2 for security. The two panels are connected together by a hinge 30 which opens downwardly. The back panel 24 is connected to the desktop 5 by a hinge 32 which opens upwardly.

The periphery of the desktop 5 is supported by the right 40, left 42 and back 43 vertical walls, which walls together comprise means for elevating the desktop above the floor a distance comfortable for working thereupon. Of course, table legs could be substituted for one or more of the walls.

The area under the desktop can be viewed as being separated into a number of vertical compartments. Underneath the free area 14 immediately to the left of the Y-axis is a knee recess 34 having at least one side (the leg-entry side) along a vertical plane that is perpendicular to the Y-axis, which side opens outward with respect to the desk. It is to be noted that the full longitudinal length of the knee recess is available for the comfort of the user. Furthermore, by removing a portion of the back wall 43 across from the existing open side of the knee recess (thereby creating a second open side), the knee recess 34 could be made available to a second person seated across from the principal user. In the configuration shown, a small amount of leg room under the desktop 5 is formed for this purpose by recessing the back wall 43 inward slightly (see FIG. 4).

To the left of the knee recess 34 may be one or more compartments 35 designed for the storage of computer peripherals, papers, or the like. The peripheral compartments 35 may include sliding shelves or drawers (not illustrated), as is common in the art. The peripheral compartments 35 are bounded by the left knee wall 46, the back wall 43 and the left side wall 42. However, peripheral compartments may be eliminated altogether in some embodiments of the invention, i.e. by shortening the desktop 5 and making the left knee wall 46 double as the left side wall so that it forms the leftmost side of the desk 1. Such a narrow desk would be useful, for example, in networked computer applications, wherein space is at a premium and storage for a printer, a CPU or other peripherals may not be needed.

Underneath the right of the Y-axis is a monitor/CPU compartment 36. The monitor compartment 36 is enclosed within the right side wall 40, a vertical right knee wall 44, the back wall 43 and a vertical front wall 37. The vertical plane of a monitor compartment door 38 preferably forms an acute door angle B with the X-axis (or the front edge 6 of the desktop), which angle B preferably is substantially equal to angle A of the front edge 26 of the lid 20, as perhaps best seen in FIG. 4. Inclining the monitor compartment door in this fashion frees up an area for the user's feet and knees which would otherwise comprise dead space, which area will be useful in some keyboard positions, as will be discussed below. The door 38 is attached to the front wall 37 by means of hinges 75 (FIG. 3) and may incorporate a second security lock 29. The front wall 37 is a convenient place for mounting an electrical switch 39, which switch operates a motor 83, also discussed below.

Lead, ferromagnetic metal, or other form of radiation-protective material forms a series of panels 74, which panels line most or all of the inner peripheral surfaces of the monitor compartment 36 and the lid 20. These panels 74 are used to help screen out potentially harmful electromagnetic radiation which is generated by the monitor 2 or the CPU 4 while those devices are in the monitor compartment 36. This danger is also reduced when the monitor is in said compartment because of the distance from the monitor to the user's head, which distance is maximized, to the extent possible within the confines of the traditional desk shape, by the corner work station configuration of the present invention.

The knee compartment or recess 34 is bounded by the back wall 43 and the right 44 and left 46 knee walls. It can be seen that the imaginary Y-axis which is used for reference herein is formed by the intersection of the planes of the right knee wall 44 and the desktop 5.

A keyboard compartment 50 for storing a keyboard 52 is attached to the lower surface of the desktop 5, just above the knee recess 34. The keyboard compartment holds a retractable keyboard shelf 54 on which the keyboard rests. The movement of the shelf 54 through successive positions can be seen in FIGS. 1–3, but is perhaps best understood by reference to FIGS. 4–7.

The keyboard compartment 50 is bounded by the left knee wall 46, the back wall 43 and a downwardly depending right shelf wall 56 which is attached to the lower surface of the desktop 5. It is further bounded below by a horizontal shelf floor 58. A pair of vertical guide blocks 60 may assist in positioning the moveable keyboard shelf 54 within its compartment 50.

Figure 4:
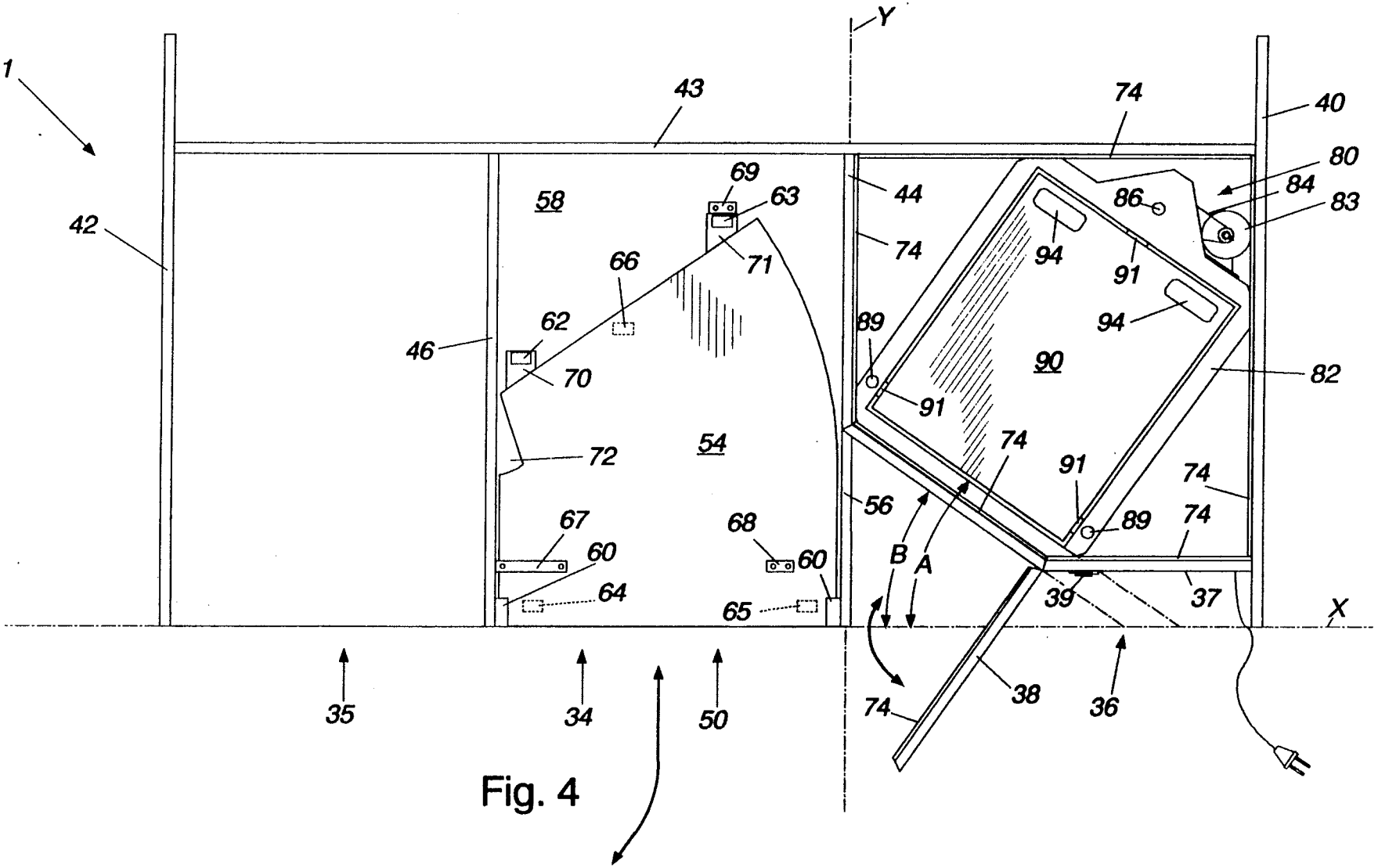
FIG. 4 is a sectional plan view of the desk, taken along line 4—4 of FIG. 3.
Figure 6:
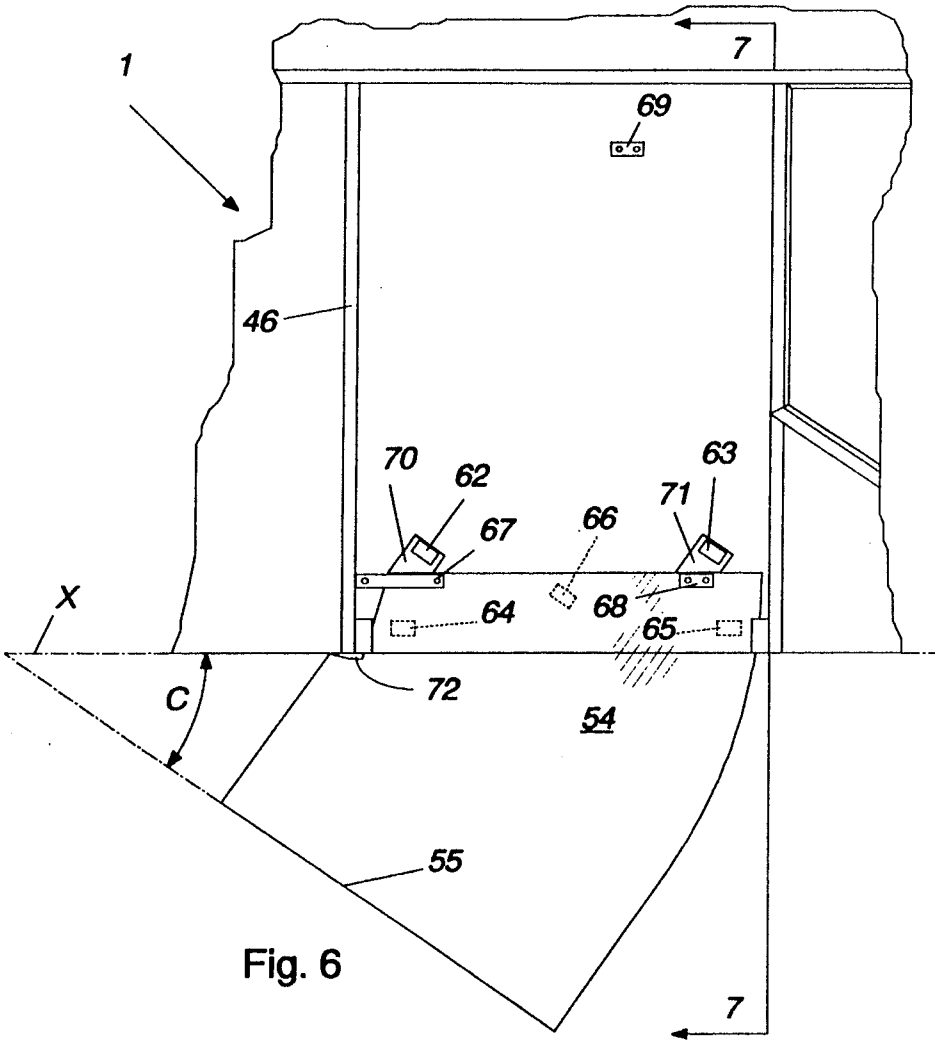
FIG. 6 is a broken sectional plan view showing the keyboard shelf in the third keyboard position.

In a first keyboard position, shown in FIGS. 1 and 4, the front edge 55 of the shelf 54 is parallel with the X-axis (the line of the front edge 6 of the desktop) and falls within the same vertical plane, i.e. the open side of the knee recess 34. Turning briefly to the schematic side view of FIG. 7, gravity causes the shelf 54 to rest on the shelf floor 58, whereupon it is supported on left 64, right 65 and back 66 rollers. Rollers 64 and 65 protrude upwardly from the shelf floor 58 and roller 66 protrudes downwardly from the shelf 54. Another pair of rollers, upper left 62 and upper right 63, are attached to the back of the shelf 54 by means of upwardly protruding brackets 70 and 71, respectively. The rollers 64 and 65 form a fulcrum which levers the back rollers 62 and 63 into continuous contact with the lower surface of the desktop 5, so that the shelf remains supported even when extended outward.

Three stoppers within the keyboard compartment 50 depend down from the desktop, namely left 67 and right 68 front stoppers and back stopper 69. When the keyboard shelf 5 is fully retracted under the desktop in the first keyboard position, the right back bracket 71 abuts against the back stopper 69 and prevents further retracting of the shelf 54. In this position, the keyboard 52 is stowed out of the way and out of sight under the desktop.

Figure 5:
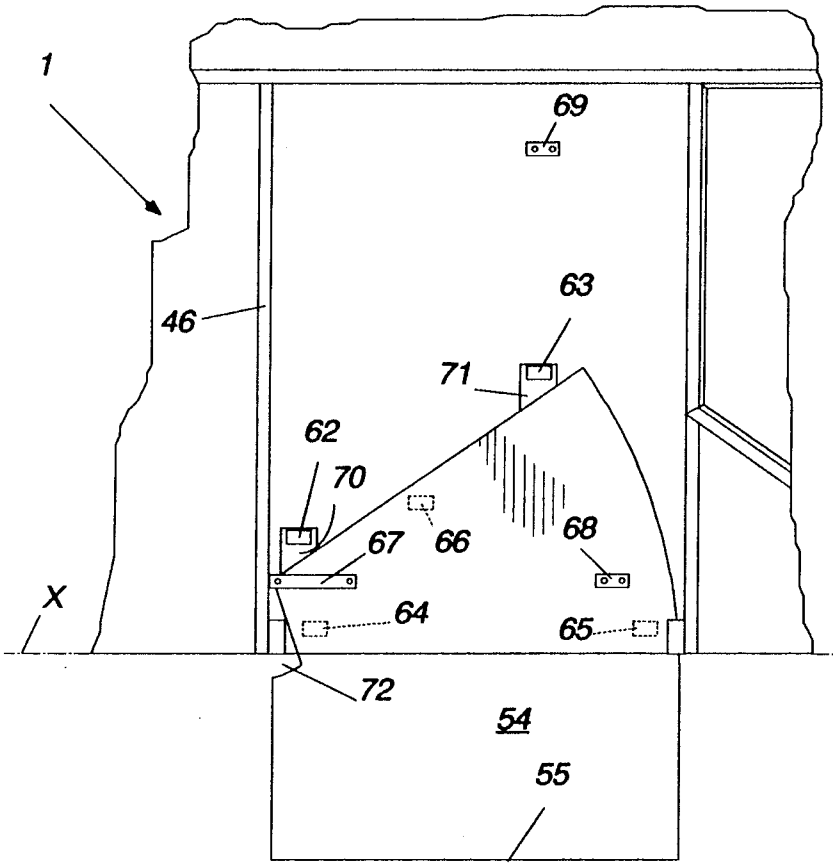
FIG. 5 is a broken sectional plan view showing the keyboard shelf in the second keyboard position.
Figure 7:
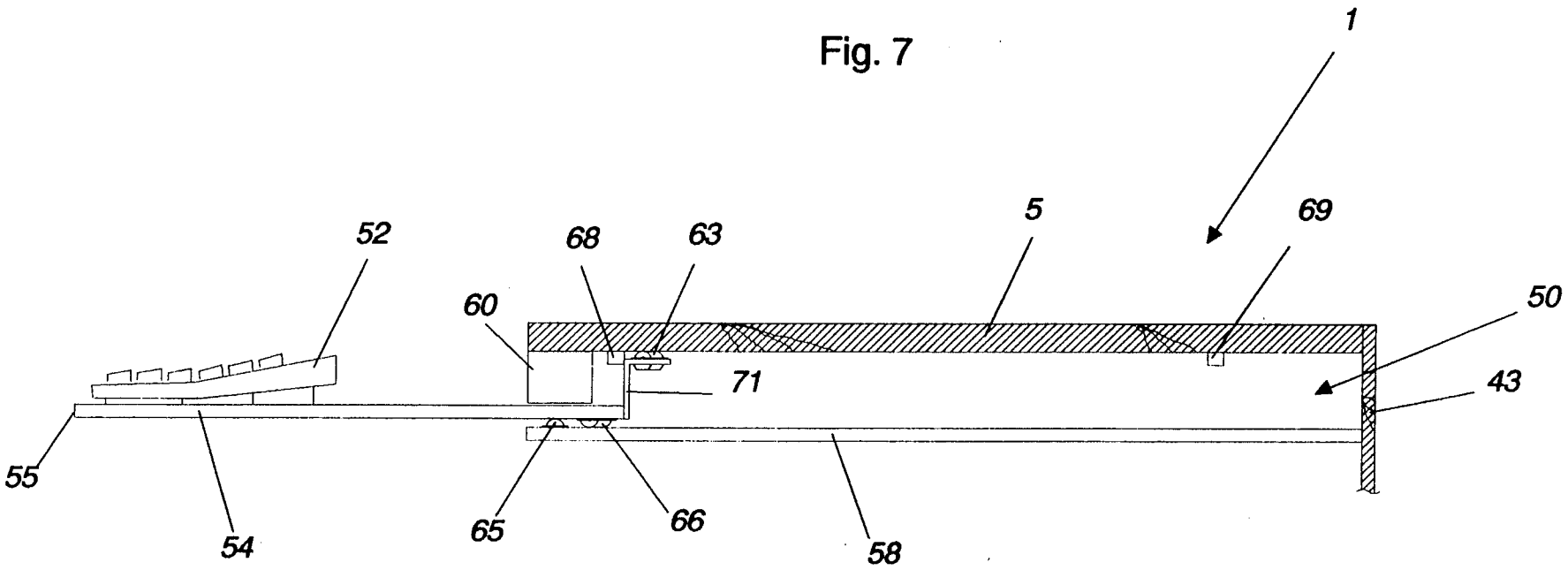
FIG. 7 is a schematic right side sectional elevation of the keyboard compartment, taken along line 7—7 of FIG. 6.

FIGS. 2 and 5 show the keyboard shelf 54 in a second, partially extended, keyboard position — a position achieved simply by grasping and pulling it directly out of its compartment 50 longitudinally. Further outward movement of the left roller 62 is prevented once its bracket 70 abuts against the stopper 67. The front edge 55 of the shelf remains parallel to the X-axis, as does the transverse (side-toside) axis of the keyboard 52 itself. The keyboard may be accessed and operated in its second position. This requires the user to face his or her body forward for correct hand placement and to turn his or head to the right to view the monitor screen 3. Thus, the second keyboard position is best for keyboarding when, for example, papers in the free area 14 above the knee recess 34 are being viewed and reference need only occasionally be made to the monitor screen 3.

When extended viewing of the monitor screen will be made, the user may wish to have the transverse axis of the keyboard 52 in line therewith. This is accomplished by further extending the shelf 54 out of its compartment 50 by turning it about a pivot formed when the bracket 70 abuts against the stopper 67 in the second position. This abutment is maintained until the shelf reaches the third keyboard position illustrated in FIGS. 3, 6 and 7. In the third keyboard position, the right bracket 71 abuts the right stopper 68, preventing all further extension of the shelf 54. A notch 72 in the left side of the shelf allows it to turn the corner formed at the front end of the left knee wall 46. The line of the front edge 55 of the shelf and the transverse axis of the keyboard now form an acute keyboard angle C with the X-axis, which angle is preferably substantially equal to the angle A that the front edge 26 of the lid 20, and, hence, the vertical plane of the monitor screen 3, make with the same X-axis. Therefore, the keyboard 52 and the plane of the monitor screen 3 will be ergonomically parallel in the third keyboard position.

Figure 8:
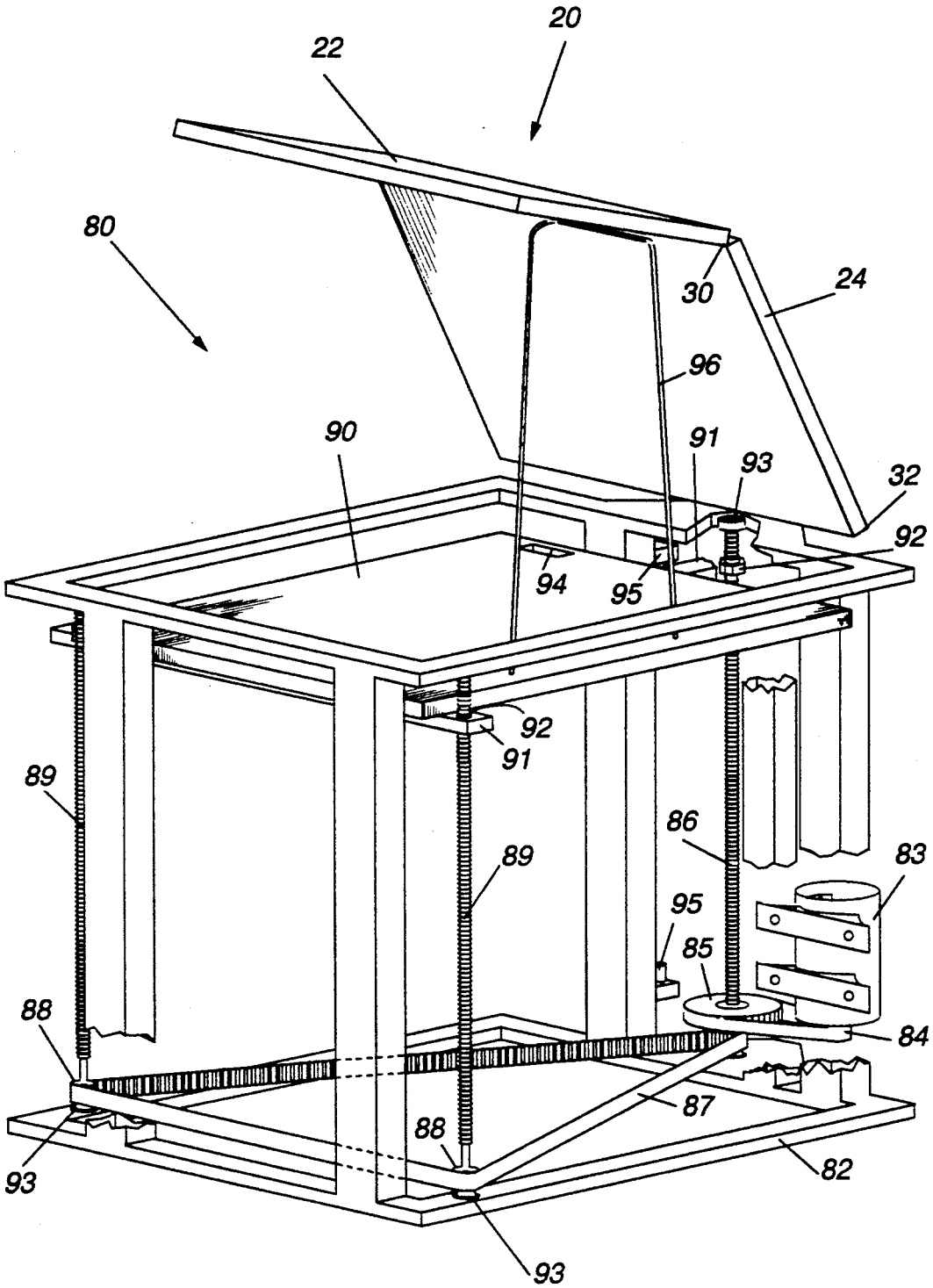
FIG. 8 is a schematic broken perspective view of the lift assembly of the desk.

FIG. 8 illustrates, in schematic and broken section, the automatic monitor lift assembly 80 (comprising lifting means) which is located within the monitor compartment 36. An electric motor 83 is mounted on the assembly frame 82 so as to be able to turn a drive belt 84. The belt 84 drives a pulley 85 which is affixed to a lift screw 86, preferably of the type generally known as an acme screw. A follower belt 87 is driven by a smaller pulley (not visible in the drawing) on the acme screw 86. Additional acme screws 89, preferably two, are driven by the follower belt 87 by means of pulleys 88.

A monitor 2 or monitor and CPU 4 (FIG. 3) rest on top of a moveable monitor platform 90. An aperture or apertures 94 ar provided in the back of the platform for directing power and other cables from the monitor 2 down into the monitor compartment 36 of the desk I wherein they are hidden from view. Bars or brackets 91 attach the platform 90 to the acme screws 86 and 89 by means of travelling nuts 92 which are rigidly affixed to the bars 91. Suitable bearings 93 for rotatably supporting the acme screws are provided in the frame 82.

The external switch 39 controls the clockwise/counterclockwise rotation of the motor 83. Rotation in one direction causes the nuts 92 to travel up the acme screws and rotation in the other direction causes downward movement. The platform 90 is thereby caused to move up and down accordingly, along with any computer equipment stored thereupon. Limit switches 95 automatically turn off the motor 83 when the platform reaches the maximum extent of upward and downward travel.

As the platform 90 rises, a push rod 96, mounted off to one side of the platform, contacts the front panel 22 of the lid 20 and pushes it upward, whereupon the front panel 22 and the back panel 124 split open about the hinge 30. The back panel 24 simultaneously folds upward about hinge 32, which hinge attaches the back panel to the desktop 5. The rod 96 thus causes the lid 120 to automatically open when the monitor platform 190 is raised, without scratching or otherwise damaging the top of the monitor 2. Of course, the lid 20 may also be lifted by hand and folded back out of the way.

Figure 9:
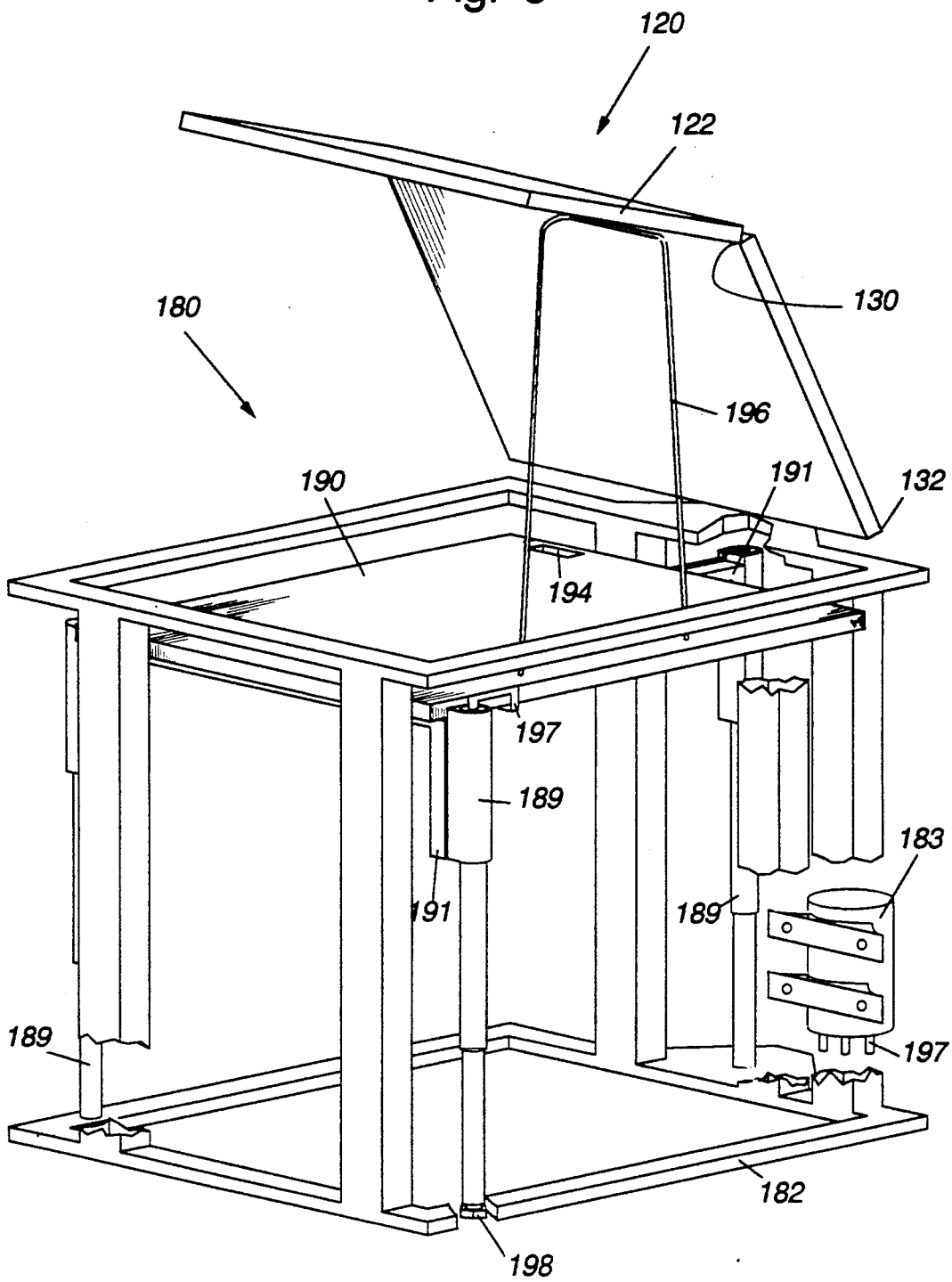
FIG. 9 is a schematic broken perspective view of an alternate lift assembly.

Other well-known means for raising and lowering a platform could be incorporated into the desk 1 of this invention. FIG. 9 illustrates, in schematic and broken section, one alternate monitor lift assembly 180 having a frame 182 which could be substituted within the monitor compartment 36 for the preferred lift assembly 80. An electric hydraulic pump 183 is mounted on the frame, which pump is able to pressurize and de-pressurize gas, oil or other hydraulic fluid in lines 197. The lines 197 operate a plurality of telescoping hydraulic cylinders 189.

A monitor 2 or monitor and CPU case 4 (not illustrated in FIG. 9) rest on top of a moveable monitor platform 190 in the manner previously illustrated in FIG. 3. An aperture or apertures 194 are provided in the back of the platform for directing power and other cables from the monitor 2 down into the monitor compartment 36 of the desk 1. Bars or brackets 191 attach the platform 190 to the cylinders 189. Base nuts 198 are provided in the frame 182 to support the cylinders.

The external switch 39 controls the pressurization and de-pressurization of the pump 183, causing the telescoping cylinders 189 to extend or retract, respectively. The platform 190 is thereby caused to move up and down accordingly, along with any computer equipment stored thereupon. Limit switches (not illustrated) automatically turn off the pump 183 when the platform reaches the maximum extent of upward and downward travel.

As the platform 190 rises, the push rod 196, located off to one side of the platform, contacts the front panel 122 of the lid 120 and pushes it upward, whereupon the front panel 122 and the back panel 124 split open about the hinge 130. The back panel 124 simultaneously folds upward about hinge 132, which attaches the back panel to the desktop 5.

OPERATION

Returning to FIGS. 1–3, the automatic conversion of the desk 1 from a conventional layout to that of a computer work station will be discussed with reference to the preferred lift assembly, namely, assembly 80 of FIG. 8.

FIG. 1 shows the desk 1 in a first keyboard and monitor position, namely, a layout in which the desktop 5 is one continuous horizontal surface, the entire area of which is available for work and storage. Of course, only the free area 14 to the left of the imaginary Y-axis is available for "permanent" storage (i.e. storage which is continuously available in both the conventional and the work station layouts). In the first position, the keyboard 52 is tucked out of the way in its compartment 50 below the desktop 5.

FIG. 2 illustrates a second monitor position, namely, one of innumerable intermediate ones in which the switch 39 has been pressed and the push rod 96 has begun to force the two-part lid 20 open. The monitor 2 is beginning to come into view in the second monitor position. It is to be understood that the monitor does not stop in the second position, which position is shown merely for convenience of illustration. However, the monitor does pass through the second monitor position as it travels, and might be made to stop there (or elsewhere) by activation of switch 39.

FIG. 2 also illustrates a second keyboard position of the keyboard shelf 54 and the computer keyboard 52. It is also to be understood that manual operation of the shelf 54 proceeds independently of the automatic operation of the lift mechanism 80. In other words, the keyboard can be extended out of or retracted into its compartment 50 at any time — during, before or after raising the monitor 2.

In its second position, the keyboard shelf 54 has been pulled longitudinally outward to the point where it is stopped (as previously explained) with the keyboard 52 facing parallel to the X-axis or the front edge 6 of the desktop 5, as is preferred in applications wherein the user spends the greater portion of time viewing papers or the like that are set out on the free area 14 of the desktop. Alternatively, this second keyboard position may be useful when a client or other person is seated opposite from the user, which person is always fully visible across the open free area.

FIG. 3 shows the third and final keyboard and monitor position of the desk 1, namely, one in which it is laid out as a computer work station. The computer monitor 2 is fully raised and the CPU case 4, if included, is positioned so that its disk drives are accessible to the user. In the third keyboard position the keyboard shelf 54 has been rotated about a stop (as previously described) so that its front edge 55 forms an angle C with the front edge 6 of the desktop which is more or less equal to the angle A which the plane of the screen 3 of the monitor 2 makes with the same front desktop edge. Therefore, the keyboard 52 is disposed parallel to the screen 3, as is preferred in applications wherein the user spends the greater portion of time viewing the screen. When the keyboard and the monitor are in their third positions, the user has extra room for his or her feet which has been freed by inclining the monitor compartment door 38 at angle B to the transverse X-axis.

FIGS. 2 and 3 also illustrate the automatic raising of the lid 20 by the push rod 96. Alternatively, the lid 20 could be raised by hand or, once automatically brought to the position shown in FIG. 3, manually rotated back further until it would rest in a position that is disposed 180 degrees from its closed position (FIG. 1), i.e. with the panels 22 and 24 folded together and resting on top of each other flat on the desktop 5. This latter position could be used, for example, should the computer operator desire to provide additional ventilation to the monitor 2 and the other computer equipment.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. Therefore, the above description and illustrations should not be construed as limiting the scope of the invention which is defined by the appended claims.

What is claimed is:

1. Desk apparatus including:

a desktop divisible by a longitudinal axis into right and left portions;

a knee recess formed under one of said portions having at least one side opening outward along a first vertical plane, which first plane is perpendicular to the longitudinal axis;

a monitor compartment formed under the other of said portions;

means for lifting at least a computer monitor from a first monitor position wherein the monitor would be fully beneath the desktop to a second monitor position wherein the monitor would be fully above the desktop; and means for elevating the desktop a distance comfortable for working thereupon.

2. The apparatus of claim 1 further including:

a straight front desktop edge formed along a transverse axis of the desktop perpendicular to the longitudinal axis, the transverse axis lying parallel to or within the first plane.

3. The apparatus of claim 2 further including:

a door of the monitor compartment lying within a second vertical plane, the second plane forming an acute door angle with the transverse axis.

4. The apparatus of claim 1 further including:

a computer peripheral storage compartment under the same desktop portion as the knee recess.

5. The apparatus of claim 1 further including:

a hinged lid in an aperture in the desktop communicating with the lifting means, the lid lying flush with the desktop in a closed lid position, the lid comprising means for sealing at least a computer monitor fully beneath the desktop when the monitor would be in the first monitor position.

6. The apparatus of claim 5 wherein:

the lifting means includes a plurality of acme screws driven by an electric motor.

7. The apparatus of claim 5 wherein:

the lifting means includes a plurality of hydraulic cylinders powered by an electric pump.

8. The apparatus of claim 5 wherein:

the lid is formed of two flat panels, a front and a back, the panels hinged together and to the desktop.

9. The apparatus of claim 8 further including:

a raisable platform in the lifting means for holding at least a computer monitor for lifting, the platform having a vertically upwardly protruding push rod which contacts the lid and opens the lid upward when the platform is raised.

10. The apparatus of claim 8 further including:

a straight front desktop edge formed along a transverse axis of the desktop perpendicular to the longitudinal axis, the transverse axis lying parallel to or within the first plane, and wherein the front lid panel is rectangular and has a front lid edge which forms an acute lid edge angle with the transverse axis.

11. The apparatus of claim 10 further including:

a lock on the lid;

a plurality of acme screws driven by an electric motor in the lifting means; and at least one limit switch in the lifting means for automatic deactivation of the electric motor.

12. Desk apparatus including:

a desktop divisible along a longitudinal axis into two portions;

a front desktop edge formed along a transverse axis of the desktop perpendicular to the longitudinal axis;

a plurality of vertical peripheral side walls depending downwardly from the desktop;

a vertical back wall depending downwardly opposite and parallel to the front desktop edge;

a knee recess formed under one of said portions having at least one side which opens outward with respect to the desk apparatus along a first vertical plane, which first plane is perpendicular to the longitudinal axis, the transverse axis lying parallel to or within the first plane, the knee recess being open longitudinally from the first plane to the back wall;

a monitor compartment formed under the other of said portions;

a vertical knee wall between the knee recess and the monitor compartment; and means for lifting at least a computer monitor from a closed monitor position wherein the monitor would be fully beneath the desktop to an open monitor position wherein the monitor would be fully above the desktop.

13. The apparatus of claim 12 further including:

a hinged lid in an aperture in the desktop communicating with the lifting means, the lid lying flush with the desktop in a closed lid position, the lid having a front lid edge which forms an acute lid edge angle with the transverse axis.

14. The apparatus of claim 13 further including:

means for extending a computer keyboard from a first keyboard position wholly beneath the desktop and back o the front edge, to a second keyboard position wholly in front of the front edge and parallel to the transverse axis, and to a third keyboard position wholly in front of the front edge and forming an acute keyboard angle with the transverse axis.

15. The apparatus of claim 13 further including:

a computer peripheral storage compartment under the same desktop portion as the knee recess; and radiation protection panels lining at least part of the monitor compartment.

16. The apparatus of claim 15 wherein:

the lifting means includes a plurality of acme screws driven by an electric motor.

17. The apparatus of claim 13 further including:

a raisable platform in the lifting means for holding at least a computer monitor for lifting, the platform having a vertically upwardly protruding push rod which contacts the lid and opens the lid upward when the platform is raised.

18. Desk apparatus including:

a desktop divisible by a longitudinal axis into right and left portions;

a knee recess formed under one of said portions having at least one side opening outward along a first vertical plane, which first plane is perpendicular to the longitudinal axis;

a monitor compartment formed under the other of said portions;

means for lifting at least a computer monitor from a first monitor position fully beneath the desktop through an intermediate second monitor position to a third monitor position fully above the desktop;

a front desktop edge formed along a transverse axis of the desktop perpendicular to the longitudinal axis, the transverse axis lying parallel to or within the first plane;

a hinged lid in an aperture in the desktop communicating with the lifting means, the lid lying flush with the desktop in a closed lid position, the lid having a front lid edge which forms an acute lid edge angle with the transverse axis;

means for elevating the desktop a distance above a floor; and means for extending a computer keyboard from a first keyboard position wholly beneath the desktop and back of the front edge, to a second keyboard position wholly in front of the front edge and parallel to the transverse axis, and to a third keyboard position wholly in front of the front edge and forming an acute keyboard angle with the transverse axis.

* * * * *